United States Patent [19]

Skinner

[11] Patent Number: 4,535,939

[45] Date of Patent: Aug. 20, 1985

[54] FUEL INJECTION NOZZLES

[75] Inventor: Robert T. J. Skinner, High Wycombe, England

[73] Assignee: Lucas Industries Public Limited Company, Birmingham, England

[21] Appl. No.: 540,570

[22] Filed: Oct. 11, 1983

[30] Foreign Application Priority Data

Oct. 23, 1982 [GB] United Kingdom ..... 8230331

[51] Int. Cl.[3] ..... F02M 61/16

[52] U.S. Cl. ..... 239/533.3

[58] Field of Search ..... 239/533.1–533.12, 239/86, 585

[56] References Cited

U.S. PATENT DOCUMENTS 3,593,924 7/1971 Eckert ..... 239/533.5
3,717,305 2/1973 Hedges ..... 239/533.3 X
4,096,999 6/1978 Eckert et al. ..... 239/533.5

FOREIGN PATENT DOCUMENTS 634024 3/1950 United Kingdom ..... 239/533.5

*Primary Examiner*—Andres Kashnikow
*Assistant Examiner*—Kevin Patrick Weldon

[57] ABSTRACT

A fuel injection nozzle for supplying fuel to an internal combustion engine includes a valve member biased by a spring to a closed position and movable to an open position by fuel under pressure supplied to an inlet of the nozzle. The opening of the valve member is initially assisted by fuel under pressure supplied to an inlet of the nozzle. The opening of the valve member is initially assisted by fuel under pressure acting upon a piston. A stop limits the movement of the piston so that the remaining movement of the valve member is due only to the fuel pressure acting on the valve member.

6 Claims, 5 Drawing Figures

FUEL INJECTION NOZZLES

This invention relates to a fuel injection nozzle for supplying fuel to an internal combustion engine and of the kind comprising a nozzle body, a bore formed in the body, a seating defined at one end of the bore, an outlet from said one end of the bore, a valve member slidable within the bore, said valve member being shaped for co-operation with said seating, a passage through which in use fuel can flow at high pressure to act upon an area of said valve member to lift the valve member away from said seating thereby to allow flow of fuel through said outlet and resilient means for opposing the movement of said valve member.

With some forms of engine combustion chamber it is advantageous to be able to control the effective size of the outlet and also the configuration of the spray which results from fuel flow through the outlet. Various forms of nozzle are known in which the lift of the valve member is arranged to take place in stages depending upon the pressure of fuel in the aforesaid passage. In some cases two or more springs are provided one only of which acts upon the valve member to control the initial opening, the remaining spring or springs being brought into operation to control the remaining opening movement of the valve member. Such nozzles because of the springs, are physically large and because it is not easy to manufacture springs to close tolerances, do not always have the desired operating characteristics. Another form of nozzle is shown in the specification of British Patent No. 1447065 in which a plunger which has a smaller cross-sectional area then the effective area of the valve member, positions a stop which is engaged by the valve member after a predetermined movement of the valve member against the action of a spring. After the valve member has contacted the stop the fuel pressure applied to the valve member must be increased substantially to cause further movement of the valve member. Such further movement takes place against the action of the spring and the force exerted by the plunger. This arrangement avoids the need for another spring but the physical construction of the nozzle is not ideal and as shown in British Application No. 2093117A it is necessary to incorporate a light spring into the design in order to guarantee the position of the plunger at the start of fuel delivery by the associated pump.

The object of the present invention is to provide a fuel injection nozzle of the kind specified in a simple and convenient form.

According to the invention a fuel injection nozzle of the kind specified includes a plunger slidable in a cylinder, passage means for admitting fuel under pressure to one end of said cylinder, the force produced by the fuel under pressure acting on said plunger opposing the action of said resilient means, and stop means for limiting the movement of the plunger, the arrangement being such that the initial movement of the valve member against the action of the resilient means, is assisted by the action of said plunger, the final movement of the valve member after the movement of the plunger has been halted, being due to the fuel under pressure acting on the valve member only.

Figure 1:
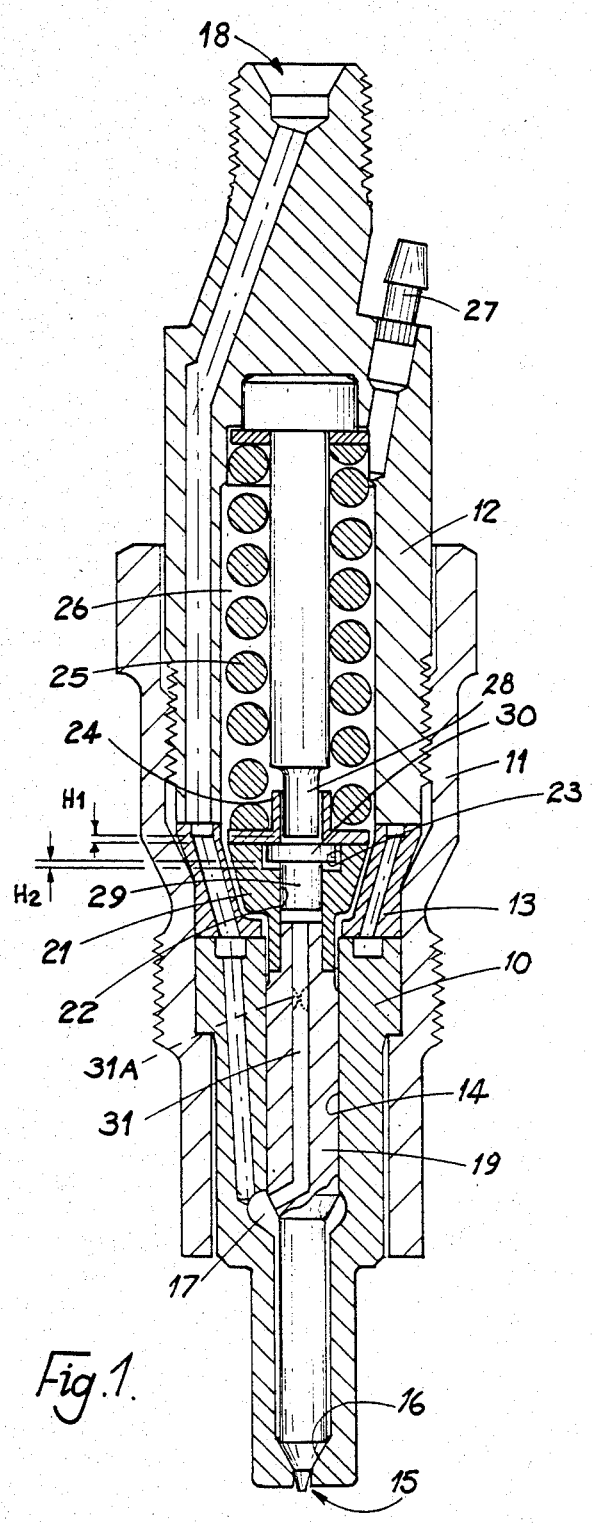
FIG. 1 is a sectional side elevation of one example of a fuel injection nozzle in accordance with the invention.

Referring to FIG. 1 of the drawings the nozzle comprises a nozzle body 10 of stepped cylindrical form, the narrower end of the body in use, being exposed within a combustion chamber of an associated engine. The body 10 defines a flange at its wider end, the flange being engaged by a cap nut 11 which holds the body 10 in assembled relationship with a holder 12, there being located between the body and the holder a distance member 13.

Formed in the nozzle body is a bore 14 which terminates in an outlet 15 and through which fuel can flow into the combustion space. Moreover, the bore adjacent the outlet defines a seating 16 and intermediate the ends of the bore there is formed an enlargement 17 which is connected by way of passages in the body, distance piece and holder, with a fuel inlet 18. The inlet in use, is connected to the outlet of a fuel injection pump.

Figure 3:
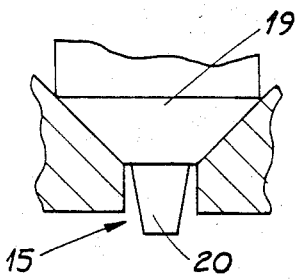
FIG. 3 is a view to an enlarged scale of part of the nozzle of FIG. 1.

Slidable within the bore 14 is a valve member 19. The valve member is a close sliding fit in the portion of the bore which lies between the enlargement and the flanged end of the body but it has clearance with the remaining portion of the bore. In addition, as more clearly shown in FIG. 3, the valve member is shaped at its end to co-operate with the seating 16 and it also is provided in this example, with a projection 20 which extends within the outlet 15.

At its ends remote from the projection, the valve member is of reduced form and mounts a generally cup-shaped adaptor 21. The adaptor is provided with a central bore 22 in which is located the reduced end of the valve member. The bore 22 opens into an enlarged portion 23 and the annular end surface of the adaptor engages a spring abutment 24 having a flange against which bears one end of a coiled compression spring 25. The compression spring 25 is housed within a chamber 26 formed in the holder 12 and the chamber in use, communicates with a drain by way of a suitable outlet 27. Located within the chamber is a stop member 28 having a reduced portion which extends into a through aperture defined in the abutment 24.

Located within the cylinder 22 is a plunger 29 and this engages a plate 30 which is accommodated within the enlarged portion 23 of the cylinder.

The end of the cylinder remote from the enlarged portion, communicates with the inlet 18 by way of passage means comprising a drilling 31 formed in the valve member and communicating with the enlargement 17 formed in the bore 14.

Figure 2:
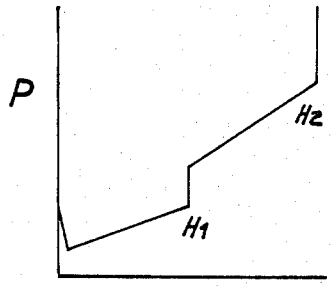
FIG. 2 shows diagrams illustrating the operating characteristics of the nozzle.

As shown in the drawings, the parts of the nozzle are in the rest position. When fuel under pressure is supplied to the inlet 18, pressure is applied to an annular area of the valve member which is exposed within the enlargement 17. In addition, fuel under pressure acts upon the plunger. It is arranged that the area of the aforesaid annular area is greater than the area of the bore 22 with the result that the fuel pressure acting on the valve member generates a force which lifts the valve member away from the seating against the action of the spring 25. A force is also generated on the plunger 29 and this force is also transmitted to the spring abutment, so that the combined forces produced by the fuel pressure acting on the valve member and the plunger oppose the force generated by the spring 25. As the valve member lifts from the seating 16, there is a slight increase in the area of the valve member exposed to the fuel pressure so that the pressure (P) of fuel which is required to further the opening of the valve member is slightly less than the initial pressure required to move the valve member. The valve member moves away from the seating to permit fuel flow through the outlet 15 and the effective area of the outlet is determined by the contour of the projection 20. As the fuel pressure (P) increases, the valve member continues to move away from the seating as indicated in FIG. 2. When the plate 30 engages the stop 28, the initial lift of the valve member (H1) is completed and since the force which is generated by the fuel pressure acting on the plunger, is now absorbed by the stop member, further movement of the valve member can only be achieved following a substantial increase in the pressure of fuel applied to the inlet. Once the increased pressure has been achieved however the valve member will continue to move until its movement is again halted by the action of the stop member. In the example, this will occur when the step defined between the cylinder 22 and its enlargement, engages the plate 30. The additional movement of the valve member (H2) represents the final movement of the valve member. It will be understood that the final movement of the valve member may be halted in other ways for example, it would be possible for the valve member itself to contact the plunger 29. As mentioned, the effective area of the outlet 15 changes with movement of the valve member and the projection 20 can be shaped to vary the spray pattern of the fuel issuing through the outlet.

In order to slow down the initial lifting of the valve member an orifice shown at 31A may be incorporated in the passage 31 and/or the clearance between the wall of the through aperture in the abutment 24 and the reduced portion of the stop member 28 may be reduced to the extent that it restricts the flow of fuel out of the space defined between the plate 30 and the stop member 28. In each case the movement of the valve member through the initial lift (H1) will be restricted.

Figure 4:
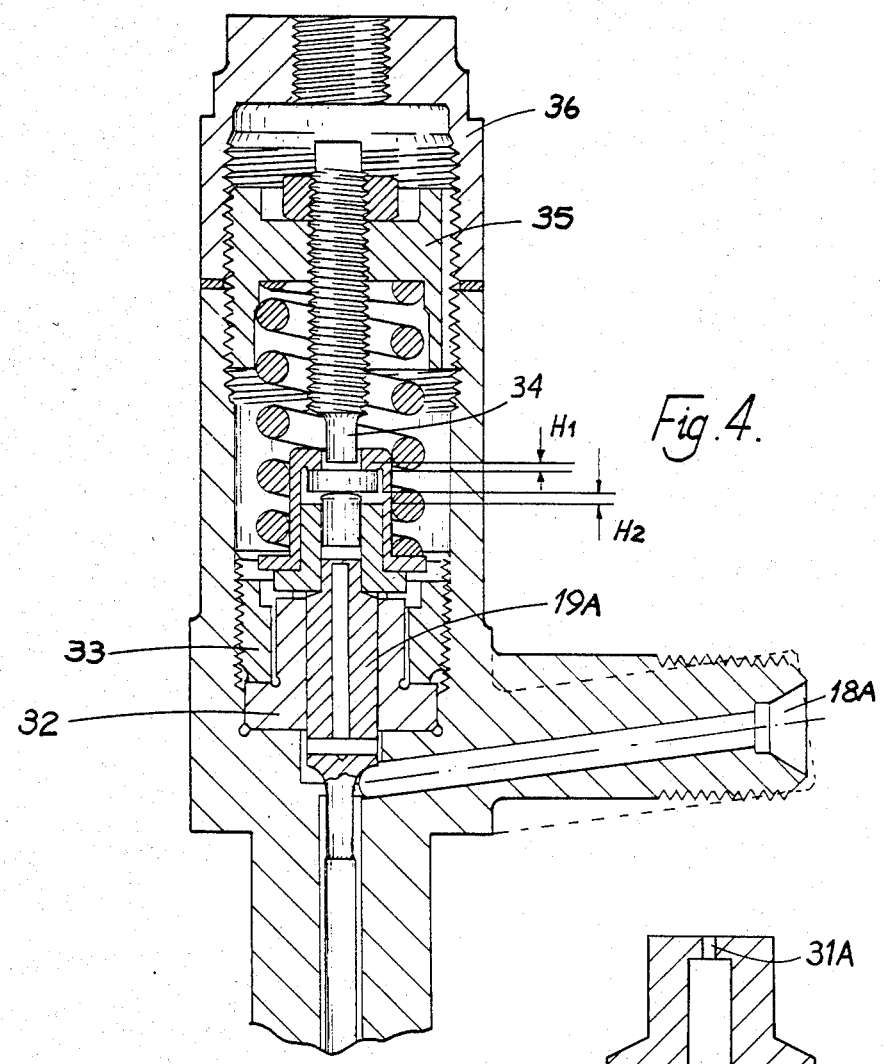
FIG. 4 is a part sectional side elevation of another form of nozzle in accordance with the invention.
Figure 5:
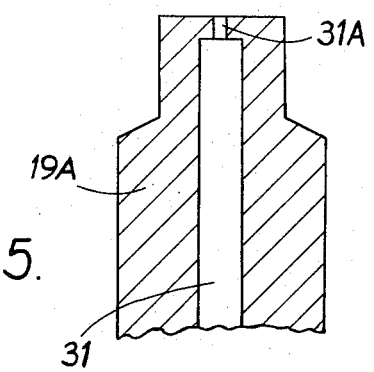
FIG. 5 is an enlarged section showing the restrictor of FIG. 4.

The nozzle which is shown in FIG. 4, is a different form of nozzle and one which is known in the art as a "pencil" injection nozzle. The main difference lies in the construction of the nozzle holder which in this case has a lateral inlet **18*a* for the fuel and the valve member 19*a* is slidably located within a bush 32 which is secured within the chamber defined by the holder, by means of a screw-threaded ring 33. The essential components of the nozzle are as described with reference to FIG. 1 with the exception that shapes have been altered. One difference however lies in the fact that the stop member 34 is adjustably mounted in an end closure 35 for the chamber. The end closure constitutes an abutment for the spring and it also serves to support a locking member 36 which additionally defines a fuel outlet for leakage fuel, the end closure 35 being provided with a slot communicating with the chamber. As with the example of FIG. 1, the initial movement of the valve member can be restricted by a restrictor 31A in the passage in the valve member and/or by control of the clearance between the stop member 34** and the spring abutment.

It will be appreciated with the construction as described, that the nozzle has only one spring and is therefore of substantially the same length as conventional nozzles. Moreover, the additional components which are necessary over a conventional injection nozzle, in order to provide for two stage operation, are separate items which can be machined exterior of the nozzle. There is no need for further machining operations to be carried out upon the nozzle body or holder.

As compared with the construction shown in British Application No. 2093117A, a spring is not necessary to position the plunger 29. At the end of fuel delivery the plunger is returned to its initial position by the action of the spring 25 and if due to the formation of cavities, it does not remain in the position shown in FIGS. 1 and 3, it will be forced to this position upon delivery of fuel by the associated pump before movement of the valve member can take place.

I claim:

1. A fuel injection nozzle for supplying fuel to an internal combustion engine comprising a nozzle body, a bore formed in the body, a seating defined at one end of the bore, an outlet from said one end of the bore, a valve member slidable within the bore, said valve member being shaped for co-operation with said seating, a passage through which in use fuel can flow at high pressure to act upon an area of said valve member to lift the valve member away from said seating thereby to allow flow of fuel through said outlet, resilient means for opposing the movement of the valve member, an adaptor mounted upon the valve member and which serves to transmit to the valve member the force exerted by said resilient means, a cylinder defined in the adaptor, a plunger slidable in the cylinder, passage means for admitting fuel under pressure to one end of said cylinder, the force produced by the fuel under pressure acting on said plunger opposing the action of said resilient means, and stop means for limiting the movement of the plunger, the arrangement being such that the initial movement of the valve member against the action of the resilient means, is assisted by the action of said plunger, the final movement of the valve member after the movement of the plunger has been halted, being due to the fuel under pressure acting on the valve member only.

2. A nozzle according to claim 1 in which said passage means comprises a further passage defined in the valve member, said further passage communicating with said first mentioned passage, and the area of the end wall of the cylinder exposed to the fuel under pressure being less than said area of the valve member exposed to the same fuel pressure.

3. A nozzle according to claim 2 in which said end wall of the cylinder is defined by a reduced end portion of the valve member.

4. A nozzle according to claim 2 including a restrictor in said further passage.

5. A nozzle according to claim 2 including a spring abutment engaging said adaptor, said spring abutment defining a through aperture, said stop means comprising a stop member extending through said aperture for engagement with a plate engaging said spring abutment and engaged by said plunger, the initial clearance between said plate and said stop member being equal to said initial movement of the valve member.

6. A nozzle according to claim 3 in which the clearance between said stop member and the wall of said through aperture is chosen to restrict the initial rate of movement of the valve member.

* * * * *